US012137725B2

(12) United States Patent
Lewerenz

(10) Patent No.: US 12,137,725 B2
(45) Date of Patent: Nov. 12, 2024

(54) POUCHED SMOKELESS ORAL PRODUCT COMPRISING AT LEAST ONE FLAVOUR CAPSULE

(71) Applicant: Reemtsma Cigarettenfabriken GmbH, Hamburg (DE)

(72) Inventor: Nathalie Lewerenz, Hamburg (DE)

(73) Assignee: REEMTSMA CIGARETTENFABRIKEN GmbH, Hamburg (DE)

( * ) Notice: Subject to any disclaimer, the term of this patent is extended or adjusted under 35 U.S.C. 154(b) by 791 days.

(21) Appl. No.: 17/272,457

(22) PCT Filed: Aug. 30, 2019

(86) PCT No.: PCT/EP2019/073243
§ 371 (c)(1),
(2) Date: Mar. 1, 2021

(87) PCT Pub. No.: WO2020/048891
PCT Pub. Date: Mar. 12, 2020

(65) Prior Publication Data

US 2021/0321656 A1 Oct. 21, 2021

(30) Foreign Application Priority Data

Sep. 4, 2018 (EP) ..... 18192337

(51) Int. Cl.
*A24B 15/28* (2006.01)
*A24B 13/00* (2006.01)
(Continued)

(52) U.S. Cl.
CPC ..... *A24B 15/283* (2013.01); *A24B 13/00* (2013.01); *A24B 15/16* (2013.01); *A24B 15/302* (2013.01); *A24B 15/403* (2013.01)

(58) Field of Classification Search
CPC ..... A24B 13/00; A24B 15/283; A24B 15/16; A24B 15/302; A24B 15/403
See application file for complete search history.

(56) References Cited

U.S. PATENT DOCUMENTS

2008/0029110 A1 2/2008 Dube et al.
2011/0083680 A1 4/2011 Mishra et al.
(Continued)

FOREIGN PATENT DOCUMENTS

CN 105831798 A 8/2016
EP 2205105 B1 * 9/2012 ..... A23L 1/22016

OTHER PUBLICATIONS

Kang, Shinee, et al., "Steady State Particle Growing with Segregation in a Fluidized Bed Granulator", 1989, Journal of Chemical Engineering of Japan, vol. 22, No. 5, p. 473. (Year: 1989).*
(Continued)

*Primary Examiner* — Michael J Felton
*Assistant Examiner* — Courtney G Culbert
(74) *Attorney, Agent, or Firm* — Fox Rothschild LLP

(57) ABSTRACT

The present invention is directed to a pouched smokeless oral product comprising a pouch containing the filling, said filling comprising or consisting of at least one of tobacco, non-tobacco plant material and a combination thereof; and one or more flavour capsules, wherein said flavour capsule is composed of a core material comprising NaCl as a carrier and at least one flavour component being in contact with the carrier; and a shell material coating the core, wherein said shell material comprises or consists of a hydrophobic polysaccharide.

16 Claims, 1 Drawing Sheet

(51) Int. Cl.

| | |
|---|---|
| ***A24B 15/16*** | (2020.01) |
| ***A24B 15/30*** | (2006.01) |
| ***A24B 15/40*** | (2006.01) |

(56) References Cited

U.S. PATENT DOCUMENTS

| | | | | |
|---|---|---|---|---|
| 2017/0280764 | A1 | 10/2017 | Sahlen et al. | |
| 2018/0235273 | A1* | 8/2018 | Carroll | A24B 15/186 |

OTHER PUBLICATIONS

International Search Report mailed in PCT/EP2019/073243 on Oct. 29, 2019.
Extended Europena Search Report Issued in EP18192337 on Feb. 28, 2019.

* cited by examiner

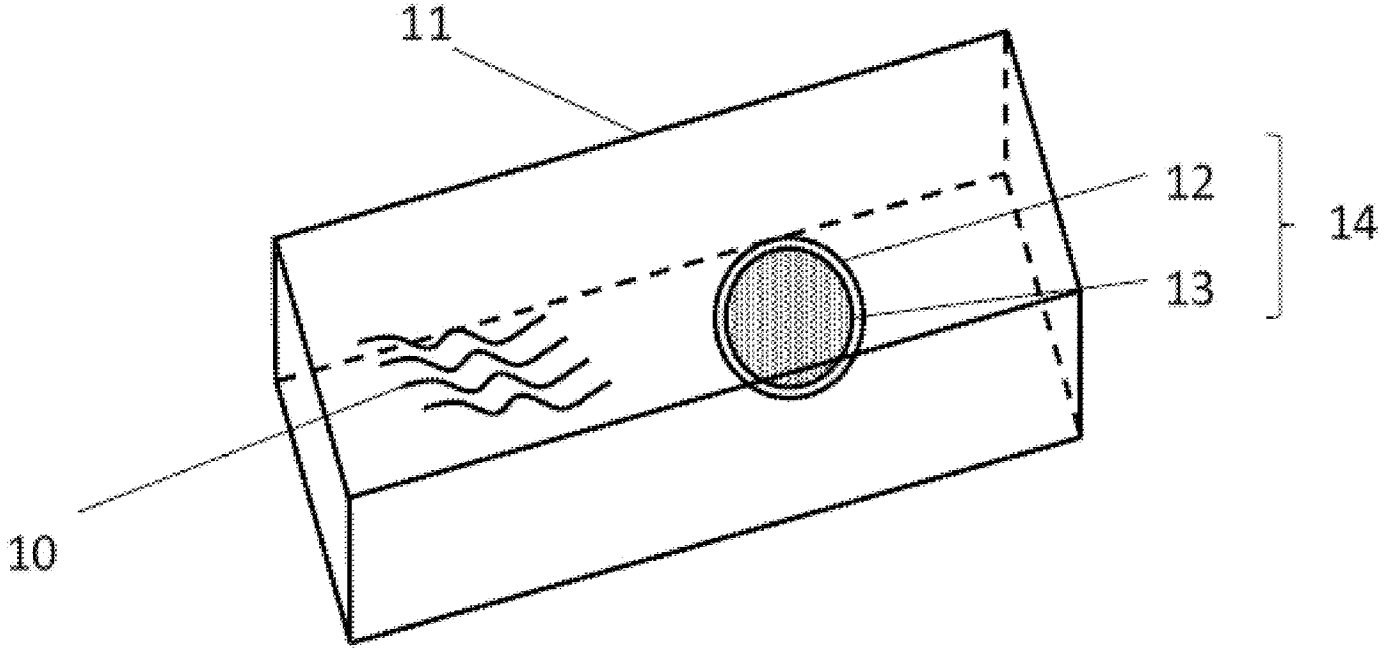
11
12
13
14
10

POUCHED SMOKELESS ORAL PRODUCT COMPRISING AT LEAST ONE FLAVOUR CAPSULE

CROSS-REFERENCE TO RELATED APPLICATIONS

This application is a § 371 national phase entry of International Patent Application No. PCT/EP2019/073243, filed on Aug. 30, 2019, which claims priority to and the benefit of European Patent Application No. 18192337.6 filed on Sep. 4, 2018, both of which are hereby incorporated herein by reference in their entireties.

Smokeless products for oral use, like e.g. pouched smokeless tobacco or non-tobacco products (e.g. snus or moist snuff), are common in a number of societies. In order to provide different products with varying taste characteristics, the filling material of such pouched products is often treated with flavour compounds or flavour enhancing materials. However, the use of filling material with relatively high moisture content has consequences on organoleptic properties, storability and taste development also with regard to flavour compounds. A well known problem with the use of flavour compounds in pouched smokeless products is the loss of flavour over time, which at least in part, is due to the moisture content of the filling material.

Consequently, there is a need for a filling material for pouched smokeless oral products which allows for the provision of flavour components in a predetermined amount and composition, which allows for significant flavour release over time and/or which provides adequate storage capabilities.

BRIEF DESCRIPTION OF DRAWING

FIG. 1 is a schematic drawing of a SNUS product accordingly to the invention.

The present invention provides a pouched smokeless oral product, preferably a pouched smokeless snuff or snus product, comprising a pouch containing a filling material, said filling material comprising or consisting of:

a) at least one of tobacco, non-tobacco plant material and a combination thereof; and b) one or more flavour capsules, wherein said flavour capsule is composed of

- a core material comprising NaCl as a carrier and at least one flavour component being in contact with the carrier; and
- a shell material coating the core, wherein said shell material comprises or consists of a hydrophobic polysaccharide.

One advantage of using NaCl as a carrier is that NaCl is well established as ingredient in products for oral consumption like e.g. food products. Thus, NaCl is available in suitable grades and qualities as well as in numerous different particle sizes. Furthermore, NaCl is easily agglomerated into particles of a desired size. Another advantage of using NaCl as carrier is the property of NaCl to act as flavour enhancer. Thus, the use of NaCl as carrier allows for use of less flavour compound and/or for disclaiming other flavour enhancers in the core material of the flavour capsule of the present invention. Furthermore, NaCl is a standard ingredient which has been used in pouched smokeless oral products already for a long time and, thus, use of NaCl as a carrier does not introduce an uncommon taste or organoleptic property to the pouched smokeless oral product of the present invention. Also, it is advantageous that a salty taste is a preferred taste in a number of countries, especially in Scandinavian countries, where pouched smokeless oral products are particularly common.

The present invention is directed to a pouched smokeless oral product. Pouched smokeless oral products are products for oral use which comprise a filling material which is encompassed in a pouch made of pouch material wherein the pouch material ensures that during consumption the particulate parts of the filling predominantly stay within the pouch while saliva- or water-soluble parts of the filling are at least in part allowed to pass the pouch material. Such pouched smokeless oral products are consumed by placing the pouched product into the oral cavity, most commonly between the lower gum and lip or upper gum and lip. By contact with the saliva, constituents of the filling elute from the pouch and are consumed by the consumer.

In the pouched smokeless oral product of the present invention, the filling material is contained in a pouch material. Pouch material suitable for use in smokeless oral products for oral consumption is well known in the art and the pouched smokeless oral products of the present invention can be manufactured with any type of such pouch material known available to the person skilled in the art. For example, the pouch material can be formed of a cellulose fiber material and can have a mesh-like structure like materials typically used for manufacturing of snus products and/or tea bags. The pouch material is preferably selected to have the desired properties of water permeability, porosity, water insolubility and tensile strength as well as wet strength. For example, the pouch material can have a basis weight of 2 to 30 $g/m^2$, depending on the final usage requirements. Further, the pouch material can have a wet tensile cross-direction (CD) strength of 10 to 100 N/m, preferable of 40 to 80 N/m.

The filling of the pouched smokeless oral product of the present invention optionally comprises non-tobacco plant material. The non-tobacco plant material according to the present invention is used in the form of plant fibres, wherein the term "fibres" encompasses plant material that is in particulate form and which, preferably but not necessarily, has an average length that exceeds the average width of the particles of the plant material.

The non-tobacco material is derived from plants other than plants of the genus *Nicotiana*. The non-tobacco material may be derived from any part of such plants, e.g. leafs, stem, roots etc., or any combination of different parts of said plants. The non-tobacco plant material comprises or consists of plant material derived from one particular plant species or from a combination of different plant species, provided that none of these plant species represents a member of the genus *Nicotiana*.

The non-tobacco plant material preferably comprises or consists of fibres derived from natural sources. However, the fibres of non-tobacco plant material may be processed before use, such as washed, ground, cut, cured, aged, dried, fermented, bleached, chemically modified and/or otherwise.

Preferably, the non-tobacco plant material comprises or consists of wheat fibres, oat fibres, potato fibres, bamboo fibres, buckwheat fibres, barley fibres, microcrystalline cellulose and/or combinations thereof. More preferably, the non-tobacco plant material comprises or consists of wheat fibres, particularly preferably the non-tobacco plant material comprises or consists of gluten-free wheat fibres.

Optionally, said non-tobacco plant material is coated with nicotine using a liquid solution comprising nicotine. Preferably, the non-tobacco plant material is coated with nicotine using a liquid solution comprising nicotine and glycerol.

More preferably, the non-tobacco plant material is coated with nicotine using a nicotine-in-glycerol solution. For the purpose of the present invention, the term "nicotine-in-glycerol solution" refers to a liquid solution wherein the combined content of nicotine and glycerol together make up at least 90 weight-% of the total weight of the nicotine-in-glycerol solution, preferably at least 95 weight-%, more preferably at least 99 weight-%. In the method of the invention, the non-tobacco plant material may be coated with nicotine using a nicotine-in-glycerol solution wherein the nicotine is present in a concentration of 2 to 20 weight-%, preferably of 5 to 15 weight-%, more preferably of 10 weight-%, based on the total weight of the nicotine-in-glycerol solution.

It has surprisingly been found that coating of non-tobacco plant material with nicotine is particularly effective and/or sustained if coating is performed using a nicotine-in-glycerol solution as defined above.

The person skilled in the art is well aware of methods suitable to coat non-tobacco plant material with nicotine using a nicotine-containing liquid solution. For example, the non-tobacco plant material can be coated with nicotine by applying the nicotine-containing liquid solution in a spray-coating process or in a drum-coating process.

Optionally, the non-tobacco plant material is coated with nicotine in such a way that the nicotine content in nicotine-coated non-tobacco plant material is within the range of 0.1 to 10 weight-%, preferably of 1 to 5 weight-%, more preferably of 2.5 to 4.5 weight-%, even more preferably of about 3.35 weight-%, wherein indications in weight-% are based on the dry weight of the nicotine-coated non-tobacco plant material.

For the purpose of the present specification, the term "dry weight" means the weight of the reference excluding the weight of water and possible also other substances that may evaporate from the reference during drying.

In addition to the at least one of tobacco, non-tobacco plant material, combinations thereof and one or more flavour capsules, the filling of the pouched smokeless oral product of the present invention optionally comprises further ingredients. The term "further ingredient" as used herein refers to any substance other than nicotine-coated non-tobacco plant material, tobacco material and flavour capsule. Such further ingredients preferably comprise one or more of water, stabilizers, humectants, plasticisers, thickeners, dyes, salts, flavours, gum base, flavour additives or any combination thereof. Exemplary embodiments of preferred further ingredients are water, NaCl, $NH_4Cl$, $Na_2CO_3$, propylene glycol, glycerine, one or more flavours and/or combinations thereof.

Optionally, the filling material of the pouched smokeless oral product of the invention has a water content of 30 to 60 weight-%, preferably of 35 to 45 weight-%, based on the total weight of the filling material.

As used herein, the term "water content" means the total water content in the filling material manufactured by the method of the invention as measured using a standardized method of water analysis, such as, Karl Fisher titration.

The filling material of the pouched smokeless oral product of the present invention is either tobacco-free or comprises tobacco material. In case the filling material is intended to be tobacco-free, no tobacco material is included and the filling comprises non-tobacco plant material. In case it is intended to provide filling material which comprises tobacco material, the filling material may be void of non-tobacco plant material or may comprise a mixture of tobacco material and non-tobacco plant material.

As used herein, the term "tobacco material" denotes any part of any member of a plant of the genus *Nicotiana* or material derived therefrom. The tobacco material may be whole, shredded, threshed, cut, ground, cured, fermented, processed, reconstituted or otherwise treated. The tobacco material may also be in the form of finished products, including any type of smokeless tobacco compositions that are orally consumed. The tobacco material used herein encompasses tobacco-containing snus material e.g. produced according to the well known technology.

The tobacco material used herein may be treated to achieve a desired colour effect or the like. Preferably, the tobacco material comprises or consists of tobacco material that has been bleached or whitened. Methods and procedures in order to prepare bleached or whitened tobacco material are known in the art and comprise the use of whiteners or bleaching agents. Alternatively or in addition, the tobacco material may be heat treated in order to arrive at a decrease of colouring agents. It is particularly preferred to prepare the whitened or bleached tobacco material by washing the tobacco material in hot water.

The filling of the pouched smokeless oral product of the present invention comprises one or more flavour capsules. The flavour capsules comprise a core encapsulated with an outer coating formed of a shell material.

The core comprises NaCl as carrier, wherein said carrier is coated, mixed or loaded with one or more flavour component(s). Thus, the core of one flavour capsule in the sense of the present invention can comprise flavour component of one type or a blend of different flavour components.

As carrier NaCl is used. Preferably, NaCl is used in solid form like e.g. a powder, granular or coarse form. The NaCl suitable as carrier material has optionally a purity of more than 90% and/or a moisture content of less than 30% by weight. Preferably, the NaCl carrier is provided in the flavour capsule as agglomerated particle, i.e. as a physical accumulation of NaCl particles, granules or coarse grains. Such agglomerated particles can have a mean particle size (e.g. mean particle diameter) of from 0.05 to 4.5 mm, preferably of from 0.1 to 2 mm, more preferably of from 0.125 to 1.5 mm.

The amount of NaCl comprised in the core material of one flavour capsule can vary and may depend on the nature and format of the flavour component(s) used. Typically, the amount of NaCl in the core material of one flavour capsule is in the range of 20% to 95% by weight of the core material, preferably of from 30% to 90% by weight, more preferably of from 50% to 80% by weight.

The NaCl carrier is coated, mixed, or loaded with flavour component. This can be achieved by any known technique suitable to combine the flavour component and the NaCl carrier. Suitable techniques to combine the flavour component(s) and the NaCl carrier comprise methods, wherein the flavour component is sprayed onto, plated onto, agglomerated with, absorbed into or mixed with the NaCl carrier material to form the core material. Optionally, the core material may be formed by agglomerating together NaCl carrier material and at least one flavour component in a fluidized bed process, wherein the at least one flavour component is preferably administered to the agglomeration step by spraying.

As used herein, the terms "flavour component", "flavour" and "flavourant" have the same meaning and can be used interchangingly throughout the present specification. These terms refer to materials which may be used to create a desired taste or aroma in a product. The present invention is not limited to the use of specific materials or compounds as flavour components but can be practiced with any flavour component known in the art. A given flavour component may consist of only one compound or may represent a mixture of different compounds, wherein one or more than one compounds add to the taste or aroma of said flavour component. Thus, a flavour component may comprise a blend of different constituents, wherein one, more than one or each constituent itself qualifies as flavour. The flavour component(s) per se may be provided in the form of a solution, e.g. an aqueous solution or an oil, or as a solid, e.g. a dry solid. Alternatively, the flavour component(s) may be provided in the form of solids dispersed in a solution, an oil emulsified in an aqueous solution or may be presented in a combination of different forms. Preferably, the at least one flavour component is selected from mint, licorice, berry, apple, cherry, rhubarb, peach, bergamot, peppery, herbal, rose, chocolate, coffee, whiskey, ginger, anise, lavender, jasmine, citrus, tobacco, smoky, woody, amaretto, and caramel, more preferably from mint, licorice, berry, rhubarb, bergamot, peppery, herbal, rose, and citrus.

The amount of flavour component comprised in the core material of one flavour capsule can vary and may depend on the nature and format of the flavour component(s) used. Typically, the amount of flavour compound(s) in the core material of one flavour capsule is in the range of 5% to 80% by weight of the core material, preferably of from 10% to 70% by weight, more preferably of from 20% to 50% by weight.

In addition to NaCl as carrier and one or more flavour component(s), the core material may comprise one or more further ingredients.

In the flavour capsule of the present invention, the core material is coated with or encapsulated within a shell material. The shell material coating the core of the flavour capsule comprises or consists of a hydrophobic polysaccharide.

For the purpose of this invention, the term "hydrophobic" is defined by the contact angle of two surfaces, one being the flat (level) surface made of the hydrophobic component (polysaccharide) and the other constituting the tangent of the surface of a droplet of distilled water at the location where the droplet meets said flat surface. Typically, this contact angle, referred to as θ, is equal to or greater than 90°, preferably more than 90°, and can be up to 180°. An angle θ of 90° signifies that the water-hydrophobic surface tension is exactly 0. If the angle θ is 180°, the water-hydrophobic surface tension equals the water-air surface tension.

As used herein, the term "polysaccharide" refers to molecules and polymers comprising more than one monosaccharide linked by glycosidic bonds. Usually, polysaccharides have from 40 to 4000 monosaccharide repeating units. Preferred polysaccharides of the present invention are starch and chemically modified starches. As used herein, the term "starch" comprises starch from natural sources, starch of synthetic origin, and compounds which result from such starch by chemical modification like e.g. hydrolysis (e.g. treatment with hydrochloric acid), acid-treatment (e.g. treatment with inorganic acid), alkaline-modification (e.g. treatment with sodium hydroxide or potassium hydroxide), bleaching (e.g. treatment with hydrogen peroxide), oxidation (e.g. treatment with sodium hypochlorite), enzyme-treatment, acetylation (e.g. esterification with acetic anhydride), and combinations thereof. Examples of chemically modified starches are acid-treated starch (INS 1401), dextrin (INS 1400), alkaline-modified starch (INS 1402), bleached starch (INS 1403), oxidized starch (INS 1404), enzyme treated starch (INS 1405, e.g. maltodextrin, cyclodextrin), monostarch phosphate (INS1410), acetylated starch (INS 1420), hydroxyethyl starch, starch sodium octenyl succinate (OSA) starch (INS 1450), and starch aluminium octenyl succinate (INS 1452).

Preferably, the hydrophobic polysaccharide is selected from starch, acid-treated starch (INS 1401), dextrin (INS 1400), alkaline-modified starch (INS 1402), bleached starch (INS 1403), oxidized starch (INS 1404), enzyme treated starch (INS 1405, e.g. maltodextrin, cyclodextrin), monostarch phosphate (INS1410), acetylated starch (INS 1420), hydroxyethyl starch, starch sodium octenyl succinate (OSA) starch (INS 1450), and starch aluminium octenyl succinate (INS 1452). More preferably, the hydrophobic polysaccharide is selected from starch, starch sodium octenyl succinate (OSA) starch (INS 1450), and starch aluminium octenyl succinate (INS 1452). Most preferably, the hydrophobic polysaccharide is starch octenyl succinate (OSA) starch (INS 1450).

In the flavour capsule of the present invention the weight ratio of core material to shell material can be within any suitable range which still allows solubilisation of the shell material and release of flavour components during consumption by a user. A suitable range for the weight ratio of core material to shell material can be from 9:1 to 4:6 by total dry weight of the flavour capsule, preferably from 9:1 to 5:5, more preferably from 9:1 to 7:3.

The core material can be encapsulated by any coating or encapsulation process known in the art. Suitable processes include spray cooling, spray chilling, spray drying, spray coating, spinning disk, coacervation, freeze drying, annular jet, extrusion such as melt extrusion, fluidized bed coating or the like. The flavour capsule can have a mean capsule diameter of from 0.1 to 5 mm, preferably of from 0.2 to 2 mm, more preferably of from 0.5 to 1.5 mm.

The flavour capsule is combined with the at least one of tobacco, non-tobacco plant material, a combination thereof, and optionally further ingredients, in order to provide a filling material of the pouched smokeless oral product of the present invention.

The flavour capsule may be added to the tobacco or non-tobacco plant material during any stage of the preparation of the tobacco material or non-tobacco plant material. In case the tobacco or non-tobacco plant material is subjected to a pasteurisation or other heat treatment step, the flavour capsules will preferably be added after such pasteurisation or heat treatment step.

In a first embodiment, the filling material of the pouched smokeless oral product of the present invention preferably comprises or consists of:

| | |
|---|---|
| 70 to 99 weight-% | at least one of tobacco, non-tobacco plant material or combination thereof; |
| 0 to 30 weight-% | further ingredients; |
| 1 to 30 weight-% | flavour capsule; |

wherein above mentioned indications in weight-% are based on dry weight of the total filling material;

and wherein the filling material has a water content of 30 to 50 weight-% based on the total weight of the filling material.

Preferably the content of flavour capsule in the filling material of the pouched smokeless oral product of the present invention is 5 to 20 weight-% based on dry weight of the total filling material, more preferably of 8 to 12 weight-%, or 10 weight-%.

According to a second embodiment, the filling material of the pouched smokeless oral product of the present invention preferably comprises or consists of:

| | |
|---|---|
| 70 to 99 weight-% | non-tobacco plant material; |
| 0 to 15 weight-% | tobacco material, preferably bleached tobacco material; and |
| 0 to 30 weight-% | further ingredients; |
| 1 to 30 weight-% | flavour capsule |

wherein above mentioned indications in weight-% are based on dry weight of the total filling material;

and wherein the filling material has a water content of 30 to 50 weight-% based on the total weight of the filling material.

Preferably, the content of flavour capsule in the filling material of the pouched smokeless oral product of the invention is 5 to 20 weight-% based on dry weight of the total filling material, more preferably of 8 to 12 weight-%, or 10 weight-%.

In particular, the present invention is directed to a pouched smokeless oral product comprising a pouch containing a filling material, the filling material comprising or consisting of:

| | |
|---|---|
| 30 to 50 weight-% | tobacco, non-tobacco plant material (e.g. nicotine-coated) or a combination thereof; |
| 30 to 40 weight-% | water; |
| 10 to 20 weight-% | flavour capsules; |
| 3 to 5 weight-% | sodium chloride; |
| 3 to 4 weight-% | propylene glycol; |
| 0.1 to 0.5 weight-% | ammonium chloride; |
| 0.05 to 0.3 weight-% | sodium carbonate; |

wherein above mentioned indications in weight-% are based on total weight of the filling material.

In a particular embodiment of the present invention, the pouched smokeless oral product of the present invention comprises a pouch containing a filling material, the filling material comprising or consisting of:

| | |
|---|---|
| 40 weight-% | tobacco, non-tobacco plant material (e.g. nicotine-coated) or a combination thereof; |
| 36 weight-% | water; |
| 16.2 weight-% | flavour capsules; |
| 4 weight-% | sodium chloride; |
| 3.3 weight-% | propylene glycol; |
| 0.1 to 0.5 weight-% | ammonium chloride; |
| 0.15 weight-% | sodium carbonate; |

wherein above mentioned indications in weight-% are based on total weight of the filling material.

The present invention is also directed to a method of manufacturing pouched smokeless oral product of the present invention. The method of the invention preferably comprises the steps:

preforming core material by agglomerating together NaCl as a carrier and the at least one flavour component in a fluidized bed process;

forming flavour capsules by coating the agglomerated core material with shell material, wherein said shell material comprises or consists of a hydrophobic polysaccharide;

mixing the flavour capsules with at least one of tobacco, non-tobacco plant material and a combination thereof and optionally further ingredients; and pouching the resulting filling material in pouch material.

Optionally, during agglomeration of the core material the at least one flavour component is administered by spraying.

The present invention is also directed to a pouched smokeless oral product manufactured according to a method of the present invention.

There is shown in FIG. 1 a tobacco, non-tobacco plant material or combination thereof 10 within a pouch 11. Also within the pouch 11 is a flavour capsule 14 composed of a core material 13 comprising NaCl as a carrier and at least one flavour component, and a shell material 12 coating the core 13.

The invention claimed is:

1. A pouched smokeless oral product comprising a pouch containing a filling material, said filling material comprising or consisting of:

a) at least one of tobacco, non-tobacco plant material and a combination thereof; and b) one or more tobacco free flavour capsules, wherein said flavour capsule is composed of a core material comprising NaCl as a carrier and at least one flavour component being in contact with the carrier, wherein the amount of NaCl in the core material is from 50% to 80% by weight of the core material; and a shell material coating the core, wherein said shell material comprises or consists of a hydrophobic polysaccharide, and the ratio of the core material to the shell material is 9:1 to 7:3;

wherein the NaCl carrier is provided in the flavor capsule in the form of agglomerated particles.

2. The pouched smokeless oral product of claim 1, wherein the hydrophobic polysaccharide is a starch or a chemically modified starch.

3. The pouched smokeless oral product of claim 1, wherein the hydrophobic polysaccharide is selected from starch, acid-treated starch (INS 1401), dextrin (INS 1400), alkaline-modified starch (INS 1402), bleached starch (INS 1403), oxidized starch (INS 1404), enzyme treated starch (INS 1405, e.g. maltodextrin, cyclodextrin), monostarch phosphate (INS 1410), acetylated starch (INS 1420), hydroxyethyl starch, starch sodium octenyl succinate (OSA) starch (INS 1450), and starch aluminium octenyl succinate (INS 1452) or a combination thereof.

4. The pouched smokeless oral product of claim 1, wherein said flavour capsule comprises in its core material a combination of more than one flavour component.

5. The pouched smokeless oral product of claim 1, wherein said filling comprises one or more additional flavour components which do not form part of the flavour capsule.

6. The pouched smokeless oral product of claim 1, wherein the at least one flavour component is selected from mint, licorice, berry, apple, cherry, rhubarb, peach, bergamot, peppery, herbal, rose, chocolate, coffee, whiskey, ginger, anise, lavender, jasmine, citrus, tobacco, smoky, woody, amaretto, and caramel.

7. The pouched smokeless oral product of claim 1, wherein the flavour capsule has a mean diameter of from 0.1 to 5 mm.

8. The pouched smokeless oral product of claim 1, wherein the weight ratio of core material to shell material is in the range of from 9:1 to 4:6 by total dry weight of the flavour capsule.

9. The pouched smokeless oral product of claim 1, wherein the total content of flavour component in the flavour capsule is in the range of from 5% to 80% by weight of the core material.

10. The pouched smokeless oral product of claim 1, wherein the filling comprises more than one flavour capsule containing different flavour components.

11. A method of manufacturing a pouched smokeless oral product according to claim 1, comprising the steps:

preforming core material by agglomerating together NaCl as a carrier and the at least one flavour component in a fluidized bed process;

forming flavour capsules by coating the agglomerated core material with shell material, wherein said shell material comprises or consists of a hydrophobic polysaccharide;

mixing the flavour capsules with at least one of tobacco, non-tobacco plant material and a combination thereof and optionally further ingredients; and pouching the resulting filling material in pouch material.

12. The method of claim 11, wherein during agglomeration of the core material the at least one flavour component is administered by spraying.

13. The pouched smokeless oral product of claim 1, wherein the at least one flavour capsule is manufactured according to a method comprising the steps:

preforming core material by agglomerating together NaCl as a carrier and the at least one flavour component in a fluidized bed process;

forming flavour capsules by coating the agglomerated core material with shell material, wherein said shell material comprises or consists of a hydrophobic polysaccharide;

mixing the flavour capsules with at least one of tobacco, non-tobacco plant material and a combination thereof and optionally further ingredients; and pouching the resulting filling material in pouch material.

14. The pouched smokeless oral product of claim 1, wherein the at least one flavour capsule is manufactured according to a method comprising the steps:

preforming core material by agglomerating together NaCl as a carrier and the at least one flavour component in a fluidized bed process;

forming flavour capsules by coating the agglomerated core material with shell material, wherein said shell material comprises or consists of a hydrophobic polysaccharide;

mixing the flavour capsules with at least one of tobacco, non-tobacco plant material and a combination thereof and optionally further ingredients; and pouching the resulting filling material in pouch material, wherein during agglomeration of the core material, the at least one flavour component is administered by spraying.

15. The pouched smokeless oral product of claim 1, wherein the agglomerated particles have a mean particle size of from 0.05 mm to 4.5 mm.

16. The pouched smokeless oral product of claim 1, wherein the hydrophobic polysaccharide is selected from starch, starch sodium octenyl succinate (OSA) starch (INS 1450), and starch aluminum octenyl succinate (INS 1452) or a combination thereof.

* * * * *